United States Patent [19]

Dingeman et al.

[11] Patent Number: 5,000,783

[45] Date of Patent: Mar. 19, 1991

[54] MODIFIED NATIVE STARCH BASE BINDER FOR PELLETIZING MINERAL MATERIAL

[75] Inventors: David L. Dingeman, Duluth; William E. Skagerberg, Cloquet, both of Minn.

[73] Assignee: Oriox Technologies, Inc., Duluth, Minn.

[21] Appl. No.: 225,471

[22] Filed: Jul. 28, 1988

[51] Int. Cl.[5] ..... C22B 1/08

[52] U.S. Cl. ..... 75/321; 75/722

[58] Field of Search ..... 75/3, 759

[56] References Cited

U.S. PATENT DOCUMENTS

| | | | |
|---|---|---|---|
| 520,377 | 5/1894 | Nienstaedt . | |
| 1,059,150 | 4/1913 | Haage . | |
| 2,130,228 | 12/1938 | Clarke | 75/3 |
| 2,450,343 | 12/1948 | Howard et al. | 23/110 |
| 2,620,267 | 12/1952 | Kern | 75/3 |
| 2,771,355 | 11/1956 | Cohen | 75/3 |
| 2,833,642 | 5/1958 | Barker | 75/41 |
| 2,864,687 | 12/1958 | Myron | 75/3 |
| 2,865,731 | 12/1958 | Crowe | 75/3 |
| 2,914,394 | 11/1959 | Dohmen | 75/3 |
| 2,914,395 | 11/1959 | Davies | 75/5 |
| 2,988,455 | 6/1961 | Rosenberg | 106/197.2 |
| 3,015,572 | 1/1962 | Casey | 106/197.2 |
| 3,060,044 | 10/1962 | Lohnas | 106/197.2 |
| 3,143,428 | 8/1964 | Reimers et al. | 99/141 |
| 3,154,403 | 10/1964 | Stickley et al. | 75/3 |
| 3,159,505 | 12/1964 | Burgess et al. | 127/32 |
| 3,235,371 | 10/1962 | Volin et al. | 75/3 |
| 3,307,927 | 3/1967 | Muschenborn et al. | 44/19 |
| 3,418,237 | 12/1968 | Booth et al. | 210/54 |
| 3,536,475 | 10/1970 | Trub | 75/3 |
| 3,585,025 | 6/1971 | Obst et al. | 75/54 |
| 3,661,555 | 5/1972 | Kusama et al. | 75/3 |
| 3,765,869 | 10/1973 | Schierloh et al. | 75/3 |
| 3,860,414 | 1/1975 | Lang et al. | 75/3 |
| 3,893,847 | 7/1975 | Derrick | 75/3 |
| 3,941,583 | 3/1976 | Martin et al. | 75/4 |
| 3,942,974 | 3/1976 | Moreau et al. | 75/3 |
| 4,004,918 | 1/1977 | Fukuoka et al. | 75/3 |
| 4,192,773 | 3/1980 | Yoshikawa et al. | 252/429 |
| 4,288,245 | 9/1981 | Roorda et al. | 75/0.5 R |
| 4,362,559 | 1/1982 | Perez et al. | 75/53 |
| 4,402,736 | 9/1983 | Graham | 75/0.5 R |
| 4,597,797 | 7/1986 | Roorda et al. | 106/194 |
| 4,659,374 | 4/1987 | Alanko et al. | 75/3 |
| 4,751,259 | 6/1988 | Roe et al. | 524/52 |
| 4,767,449 | 8/1988 | Rosen | 75/3 |
| 4,802,914 | 2/1989 | Rosen | 75/3 |

FOREIGN PATENT DOCUMENTS

| | | |
|---|---|---|
| 533975 | 12/1956 | Canada. |
| 80342 | 1/1972 | Canada. |
| 897495 | 5/1960 | United Kingdom . |
| 1217274 | 12/1970 | United Kingdom . |
| 1324838 | 7/1973 | United Kingdom . |
| 1403187 | 8/1975 | United Kingdom . |

OTHER PUBLICATIONS

Rosen, "Carbinder TM Polymer 498: A New Organic Binder For Taconite Ore", ©1988 Union Carbide Corp.

Byrns, "Briquetting Fine Ores at Woodward, Ala.", ©1949 American Institute Mining and Metallurgical Engineering, Inc.

Fine and Wahl, "Iron Ore Pellet Binders From Lignite Deposits", 1964, U.S. Department of the Interior, Bureau of Mines R1-6564.

Haas et al., "Sampling, Characterization, and Evaluation of Midwest Clays for Iron Ore Pellet Bonding", 1987, U.S. Dept. of the Interior, Bureau of Mines RI-9116.

Goetzman et al., "An Evaluation of Organic Binders As Substitutes for Beutonite In Taconite Pelletizing", 1988, 61st Annual MN Section AIME and 49th Mining Symposium of the Univ. of MN.

Kenworthy, "Nodulization and Pelletization of Fluorite Flotation Concentrates", 1951, U.S. Dept. of the Interior, Bureau of Mines.

*Primary Examiner*—Peter D. Rosenberg

*Attorney, Agent, or Firm*—Merchant, Gould, Smith, Edell, Welter & Schmidt

[57] ABSTRACT

A binder for pelletizing particulate mineral material. The binder including about 50-99.5% modified native starch, and about 0.5-50% of water-dispersible polymer material selected from the group consisting of water-dispersible nature gums, water-dispersible pectins, water-dispersible starch derivatives, water-dispersible cellulose derivatives, water-dispersible vinyl polymers, water-dispersible acrylic polymers and mixtures thereof. An iron ore concentrate is also disclosed as are mineral ore and iron ore pellets. In addition, methods of binding particulate mineral material and of making mineral ore pellets are also disclosed.

26 Claims, 2 Drawing Sheets

MODIFIED NATIVE STARCH BASE BINDER FOR PELLETIZING MINERAL MATERIAL

FIELD OF THE INVENTION

The present invention relates to modified native starch base binders for pelletizing particulate mineral materials and to mineral ore pellets containing the novel binders. Methods of using the novel binder are also disclosed.

BACKGROUND OF THE INVENTION

In order to reduce impure deposits of iron ore to commercially usable grades of iron, impure deposits of iron ore are generally concentrated and pelletized prior to reduction processing in blast furnaces. Pelletizing impure mineral deposits has grown into a very large industry since the end of World War II. Mineral ores of various kinds are pelletized for ore production but the process is most commonly with impure iron ores, such as taconite. Approximately 40 million tons of iron ore pellets are produced annually in the United States and another 30 million tons are produced in Canada. Other significant pellet production facilities exist in several other countries including Brazil, Australia, Turkey, India, Norway and Japan.

High grade iron ore deposits in the United States were severely depleted by the war effort during Word War II. In order to continue to produce steel in blast furnace operations in the U.S., alternate sources of iron were needed to feed the blast furnaces. The University of Minnesota and a number of steel companies concentrated their efforts on developing technology to upgrade low grade magnetic ores, commonly called taconite, into an acceptable iron ore feed for these blast furnaces. Taconite, which is abundant in Minnesota's Iron Range, typically contains about 25% magnetic iron as compared to the roughly 50–70% iron content of some higher grade iron ores. In order to use taconite in place of the higher grade ores in commercial reduction processes, the iron content of the taconite needed to be concentrated.

The process for concentrating the iron in taconite evolved to include blasting the taconite and crushing it into particles small enough to liberate most of the grains of magnetite. The pulverized ore is then upgraded to an iron content in excess of preferably about 67% iron in a series of concentrating steps. The resulting mineral material is typically an aqueous slurry which is filtered or otherwise reduced to a moisture content of between about 9–10% by weight.

This material cannot be added directly to a blast furnace because the average particle size is so small, typically in a range of about 10–40 microns in diameter. Small particles such as these can plug a blast furnace. In addition, they are often lost as air entrained dust when fed directly into a blast furnace. It was believed, however, that this problem could be overcome by agglomerating the resulting mineral material. The need for some method of agglomerating this material subsequently led to the development of the iron ore pelletizing industry.

The commercial pelletizing or agglomeration process is generally a continuous process in which filtered mineral material is conveyed into balling drums or "disks" to form pellets. The rotating drum or disk causes the concentrated mineral material to roll into balls, typically called "green" or undried balls or pellets.

Green ball growth is somewhat similar to the growth of a snowball when it is rolled in wet snow. As the ball is rolled, successive layers are added as the ball grows to form a large ball. Seed pellets are initially formed from the mineral material by the rolling action of the drum. During commercial operation, pellets are typically screened at the drum discharge and the undersized pellets are recycled back into the drum as seed pellets until they have grown to form a ball having a diameter of about ½ inch (about 1.25 cm).

These green pellets are typically screened to remove pellet fines, dried at increasingly higher temperatures, and "fired" at a temperature of about 2400° F. (1315° C.) When the pellets are fired, the iron grains grow together to form somewhat porous iron matrices which provide strength to enable the pellets to survive significant handling at shipping and receiving sites during transshipment.

Early in the development of the pelletizing industry, it was recognized that green pellets without "binding" agents were not suitable for subsequent processing steps. For example, the green pellets often broke during the balling process or during the initial stages of the drying process. Therefore, it became necessary to add a binding agent or "binder" to the moist mineral material fed into the balling drum. Many different additives were tested before it was determined that bentonite clay or "bentonite" would provide the binding strength required. Subsequently, bentonite became the standard balling additive or binder used in the pelletizing industry. Bentonite clay is typically added to the mineral material at rates of somewhere between about 10–25 pounds per long ton (2,240 pounds) of pellets.

Unfortunately, bentonite contains significant amounts of certain materials which shorten the useful life and lower the performance of blast furnaces. One of these materials is silica which is undesirable because excessive amounts of silica result in excessive amounts of slag which must be removed from blast furnaces during processing. The silica in bentoninte also has the undesirable effect of melting and reforming into a glassy coating which can coat the surface of the iron particles within the pellet. This phenomenon adversely affects the ability of blast furnace reducing gasses to enter the pellets, thereby lowering blast furnace productivity. Bentonite is about 60% silica. Bentonite also contains other undesirable elements such as sodium and potassium. Sodium and potassium apparently react with the refractory linings of blast furnaces, thereby reducing the useful life of each furnace lining. In addition, these elements are believed to cause pellets to exhibit undesireable "swelling" when processed in blast furnaces.

Over the years, there has been intensive research to develop a binder that does not have these undesirable characteristics. Among the many inorganic and organic binders which have been tested are clays, paint rock, soda ash, limestone, lime, hydrated lime, iron sulfates, amines, amine carboxolates, animal proteins (e.g. dried blood), manures, cereal grains, flours, hulls, corn cobs, gelatins, glues, gums, humic acids, lignins, lignosulfonates, pulp, polyacroleins, polyacrylamides, polyamines, starch, sugar, surfactants, wood chips, wood flour, carboxymethylcellulose (CMC), molasses, corn syrup, graft copolymers of acrylic acid, pozzuolan, cement, tar, pitch, polyvinyl alcohols, dolomite synthetic organic dispersants and high molecular weight substantially straight chain water-soluble polymers.

The complexity and difficulty of finding a practical and functional substitute for bentonite, however, has been demonstrated by the continued use of bentonite as a binder. Today, bentonite remains the principal commercial binding agent used in industry.

Progress has been made toward resolving the complex technical problems inhibiting the use of organic binders, however. Sodium carboxymethylcellulose (CMC), used in conjunction with soda ash, has proven to be an acceptable binder in some operations and continues to be used in several commercial operations today. Similarly, copolymers of sodium acrylate and acrylamide, used in conjunction with soda ash, also show promise as binding agents.

Efforts to use other binders, however, such as starch in particular, have not been favorably received. Modified native starch would appear to be an excellent candidate as a binding agent. Substantial supplies of native starch of a consistent quality are widely available at relatively low cost, especially as compared to synthetically produced organic binders such as those mentioned hereinabove. Starches do not contain significant amounts of silica, sodium or potassium. In addition, starches are also believed to be relatively insensitive to variations in the "water chemistry" or ion concentration levels of the moisture contained in the concentrated mineral materials. Furthermore, modified native starches generally exhibit strong binding characteristics which are desirable in good binders.

Despite extensive testing of starch binders during the past thirty plus years, however, starch has yet to find commercial acceptability as a binder in the pelletizing industry. In spite of its broad availability, attractive cost, lack of undesirable constituents, general insensitivity to water chemistry, and strong binding characteristics, starch is generally believed to be unacceptable as a binder for pelletizing particulate mineral material. Some of the reasons why starch is believed to be an unacceptable binder, include the following negative characteristics of starch binders:

1. Starch binders generally result in excessive tackiness on the surface of "green" pellets. This allows excessive amounts of mineral concentrate fragments to collect on the surface of green balls when sufficient starch binders are added to maintain acceptable drop strength and dry compression strength at typical concentrate moisture levels. It is believed, but not relied upon, that starches do not readily retain water in the interior of the green balls. This is believed to result in unacceptably low green ball moisture content in the interior of the balls and unacceptably high moisture content on the surfaces which tend to be considered wet or tacky.
2. Starches exhibit the unacceptable characteristic of encouraging rapid and uneven ball growth during balling operations. This is thought to be due to excessive tackiness on the surface of the balls which is characteristic of pellets made from mineral concentrates including starch base binders, and generally results in pellets which display poor strength characteristics.
3. Pellets bound with starch generally have a rough surface exhibiting surface "cratering" and a surface characteristic commonly referred to as "orange peel". Such rough surface characteristics commonly result in unacceptable tonnage losses during transshipment due to abrasion between adjacent pellet surfaces Because of these and other problems associated with the use of starch binders to pelletize particulate mineral material, starch base binders are generally considered to be unacceptable in the art. A need has been demonstrated for an inexpensive organic binder for pelletizing mineral ores. Therefore, because of the attractive characteristics of native starch, discussed above, a need also exists for a starch base binder and a method of using native starch as a binder for particulate mineral material which will prove to be acceptable within the pelletizing industry. The present invention addresses these and other needs and problems associated with the formation and use of mineral ore pellets in the pelletizing industry. The present invention also offers other advantages over the prior art and solves other problems associated therewith.

SUMMARY OF THE INVENTION

The present invention provides a binder for pelletizing particulate mineral material. The binder comprises about 50–99.5% modified native starch, and about 0.5–50% of water-dispersible polymer material selected from the group consisting of water-dispersible natural gums, water-dispersible pectins, water-dispersible starch derivatives, water-dispersible cellulose derivatives, water-dispensible vinyl polymers and water-dispersible acrylic polymers and mixtures thereof. Preferably, the polymer material is selected from the group consisting of water-dispersible acrylic polymers, water-dispersible vinyl polymers, water-dispersible cellulose derivatives, water-dispersible natural gums and mixtures thereof. Most preferably, the binder is substantially free of inorganic elements, preferably substantially free of potassium, sodium and silica.

The binder of the present invention provides many advantages over the prior art binders. It is preferably an organic binder containing none of the undesirable constituents found in clay binders such as bentonite. As stated in the Background of this specification, starch is readily available and quite inexpensive as compared to synthetic organic binders. In addition, the quality of the starch may be consistently maintained. Furthermore, native starches are relatively insensitive to variations in water chemistry and they exhibit desirable binding characteristics.

In order to find commercial acceptability within the pelletizing industry, however, mineral ore pellets are generally required to have the characteristics which are discussed below. In the past, starch base binders were not used because pellets made with such binders did not meet these requirements. The inventive pellets, however, do meet these requirements. Therefore, it is deemed to be extremely likely that pellets made in accordance with the present invention will find acceptability within the pelletizing industry after introduction of the novel binder. The characteristics which are believed to be critical for good quality pellets include the following. Green pellets must be able to survive repeated drops without cracking as they pass over a number of conveyors between the balling drums or disks and the firing furnace. If the pellets are not strong enough to resist cracking prior to being fired, the fired pellets will have low physical strength and may break during transshipment Such breakage generally results from "microcracks" which develop in the green balls as they are conveyed to the furnace. Their resistance to cracking is measured by the "18 inch drop test". This test measures the number of times a green ball or pellet can be dropped 18 inches onto a hard, flat surface without cracking Typically, 20 balls will be dropped until they crack. The drop strength of the balls is then calculated by averaging the number of times each of the 20 balls can be dropped before each ball cracks. An average green ball drop strength of 5 or better at about 9.5% moisture content is generally desireable in many industry pelletizing operations.

In addition, the pellet must be strong enough to survive the drying process and to maintain sufficient strength to prevent collapse of the pellet structure during "firing" until the iron oxide particles grow together and provide the high compressive strength required for the pellet to survive transshipment to the blast furnace location. This characteristics is commonly referred to as the "dry strength" and is determined by measuring the fracture strength of pellets in the minus ½ inch plus 7/16 inch category (balls smaller than ½ inch and larger than 7/16 inch). Typically, 20 green pellets are pre-dried at 105° C. and then compressed until they break. The average dry strength is reported in "pounds compression". A dry strength of 5 or better is generally desired by most pelletizing operations.

Furthermore, the pellets should have a relatively smooth outer surface to minimize abrasion or "dust" losses after the pellets are fired. If the pellet surface is too rough, as has commonly been the case with prior art pelletizing methods utilizing starch, the pellet will chip and abrade along the surface during transshipment. This results in severe tonnage losses Because it is essential to limit these tonnage losses, the pellet surface is generally considered to be unacceptable if it is "cratered" or includes rough protrusions.

In addition, the green pellet surface must not be wet or "tacky". If the surface is tacky, pellet and concentrate fragments will stick to the tacky pellet surface and be carried over the screens which are used to remove and recycle green pellet fines from the furnace feed. Fines stuck to the pellets will eventually break off of fired pellets during subsequent operations, thereby creating greater transportation and/or transshipment tonnage losses which further degrade pellet quality.

Also, variations in concentrate moisture can have a significant effect on balling action and subsequent ball quality. Binders must generally accommodate some fluctuation in moisture content in order to allow rough estimation of this parameter in every day balling operations. Therefore, it is important that the binder be able to compensate for fluctuations in concentrate moisture by producing stable quality green balls over a fluctuating range of green ball moisture levels of about 9.0–10.0 percent moisture.

Furthermore, the binder must not cause the green ball to grow too rapidly during the balling process. Stronger balls are believed to be formed when the diameters of the green pellets are increased in relatively small increments. Such balls have relatively thin conchoidal layers, whereas rapid ball growth generally results in weaker pellets having relatively thick conchoidal layers. These pellets are subject to erosion or disintegration drying process, and may spall during firing. In addition, the fired pellets should have significant resistance to abrasion, as measured by the tumble test, relatively high porosity, and a high compressive strength. They should also reduce to iron rapidly as measured by the reducibility test, have high resistance to degradation in the upper area of the blast furnace as measured by the low temperature degradation test and have low swelling characteristics as measured by the swelling test.

Unlike pellets having binders consisting solely of starch, pellets having a binder comprising modified native starch and water-dispersible polymer material in accordance with the present invention, generally possess the desired characteristics set forth above and lack the undesirable ones. Experimental evidence indicates that the use of the water-dispersible polymer material to modify the characteristics of modified native starch base binders results in green pellets which do not have excessively tacky surfaces. Such pellets grow at a much slower rate of growth during conventional balling processes than pellets having binders consisting solely of starch. They are also less erodible as measured by the tumble test.

The Applicants have also observed that the binder of the present invention reduces or eliminates the undesirable rough pellet surface characteristics generally observed for pellets with starch binders. The surfaces of dried pellets made with the inventive binder are smoother than the rough surfaces of pellets having binders consisting solely of starch, and result in reduced abrasion losses. In addition, because modified native starch base binders are not very sensitive to variations in "water chemistry", the novel binder is particularly desirable in respect to binding consistency. Furthermore, the present binders preferably contain substantially no sodium or potassium, thereby minimizing the tendency for the pellets to swell during firing, and substantially no silicates, thereby minimizing the production of slag and other undesireable characteristics associated with their presence.

As used herein, the following terms have the following meanings. The term "native starch" means starch which can be found :n nature. The term "modified native starch" means native starch which is at least partially gelatinized such that the binding characteristics of the native starch are improved. The term "water-dispersible polymer material" means material including water-dispersible polymers. "Water-dispersible" means either dispersible in water or other aqueous media, or soluble in water or other aqueous media. The term "percent" (symbolized by %) means percent by weight. In addition, the term "aqueous" means having water as a primary solvent. The term "organic binder" means a binder which is substantially without significant metal (including alkali metal) or silicate content. The term "rate of growth" means the rate at which green balls of a certain size are generated from concentrate in comparative experimental balling operations. Additional terms are defined hereinbelow.

The above described features and advantages along with various other advantages and features of novelty are pointed out with particularity in the claims of the present application. However, for a better understanding of the invention, its advantages, and objects attained by its use, reference should be made to the drawings which form a further part of the present application and to the accompanying descriptive matter in which there is illustrated and described preferred embodiments of the present invention.

BRIEF DESCRIPTION OF THE DRAWINGS

In the drawings, in which like and primed letters indicate corresponding embodiments of the present invention and the prior art throughout the several views.

DETAILED DESCRIPTION OF THE PREFERRED EMBODIMENTS OF THE INVENTION

Figure 1:
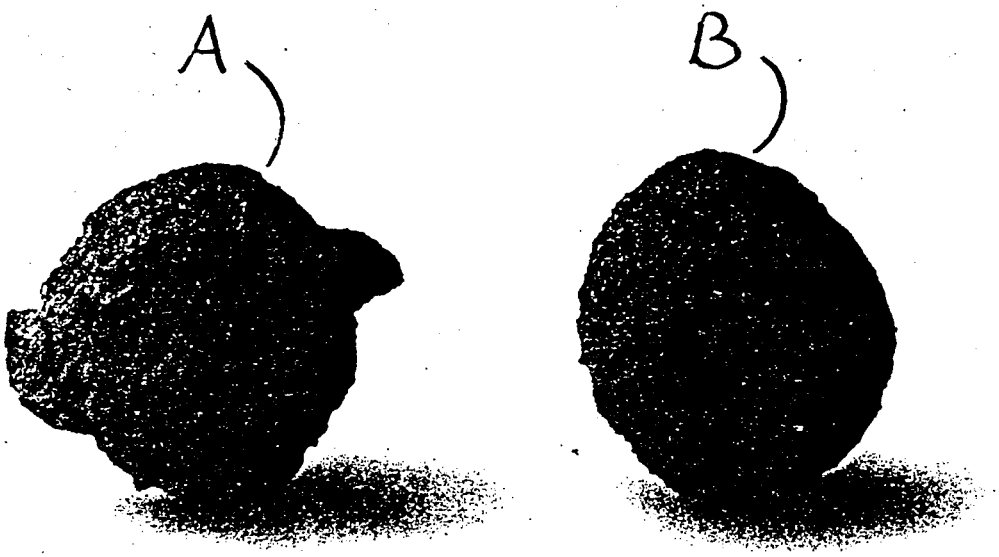
FIG. 1 is a photographic depiction of a magnified view of two pellets having binders including modified wheat starch, pellet B being a preferred iron ore pellet in accordance with the present invention and pellet A being an iron ore pellet made with a modified starch base binder not within the scope of the present invention.

In accordance with the present invention, a modified native starch base binder is provided for pelletizing particulate material, preferably particulate mineral material. The binder comprises, and can be prepared by mixing, about 30–99.8%, preferably about 50–99.5%, more preferably about 75–99.5% modified native starch and about 0.2–70%, preferably about 0.5–50%, more preferably about 0.5–25% of a binding modifier, preferably water-dispersible polymer material. The binding modifier will preferably include an amount of water-dispersible polymer material effective to reduce the rate of growth of mineral ore pellets during conventional balling processes when said pellets include modified native starch base binders.

The binder of the present invention is preferably used for pelletizing particulate mineral material such as iron ores including taconite and the like, as well as other mineral ores, for reduction in metal ore reduction processes such as blast furnace operations common to the United States and many other countries.

Also in accordance with the present invention, an iron ore concentrate for forming iron ore pellets is provided. The concentrate comprises about 50–99.98%, preferably about 80–99.98%, more preferably about 90–99.98% mineral material including about 6–12%, preferably about 8–11%, more preferably about 9–10% moisture and at least about 35%, preferably about 45%, more preferably about 50%, and most preferably about 60% iron; about 0.01–0.5%, preferably about 0.02–0.5% modified native starch; and an amount of water-dispersible polymer material effective to reduce the rate of growth of green pellets during conventional balling processes when said green pellets have modified native starch base binders. Preferably, the concentrate includes about 0.001–0.1%, more preferably about 0.002–0.08% of water-dispersible polymer material.

In addition, the present invention provides a mineral ore pellet comprising about 50–99.98%, preferably about 80–99.98% mineral material; about 0.01–10.0%, preferably about 0.01–1.0%, more preferably about 0.01–0.5% modified native starch; and an amount of water-dispersible polymer material effective to reduce the rate of growth of mineral ore pellets during conventional balling processes when said pellets include a modified native starch base binder. Preferably, the mineral ore pellet includes about 0.001–1.0%, more preferably about 0.001–0.5%, most preferably about 0.001–0.1% of water-dispersible polymer material and at least about 35%, preferably about 45%, more preferably about 50% iron. Alternatively, the present invention provides an iron ore pellet comprising 90–99.98% mineral material including at least about 50% iron and having a moisture content of about 6–12%, preferably about 8–10%; about 0.01–0.5% modified native starch; and, an amount of water-dispersible polymer material effective to reduce the rate of growth of mineral ore pellets during conventional balling processes when said iron ore pellets include a modified native starch base binder.

Native starch is any starch which can be found in nature. Such starch includes, but is not limited to, starch from the following sources: corn (Zea mays), wheat, triticale, tubers, rice, or the like. Native starch is virtually insoluble in cold water. Modified native starch is native starch which has been at least partially gelatinized such that the binding characteristics of the native starch are improved. When starch is heated it tends to become soluble in water forming a colloidal solution which may form a gel on cooling. During heating, the amylose and amylopectin moieties of the starch granule depolymerize to one degree or another. This process is called gelatinization. Starch can be gelatinized by depolymerizing the amylose and amylopectin in several ways. Heat is most commonly used to gelatinize starch, however, a hydrolysis reaction depolymerizing amylose and amylopectin may also occur when the starch is treated with acids, enzymes, or other well known chemical agents. Starch is gelatinized during heat processing when a starch-water mixture is heated to a temperature exceeding the temperature at which the quasi-crystalline or aggregate structure of the water-swollen starch granules are irreversibly destroyed. This temperature is commonly referred to as the gelatinization temperature. The gelatinzation temperature can be reduced by including hydrolytic agents in the starch-water mixture. Such agents include, but are not limited to acids, alkalies, amylolytic enzymes and the like. For example, it is possible to dissolve caustic soda in a starch-water mixture in order to reduce the gelatinzation temperature to about 20°–30° C. In such a case, no heating is required if the ambient temperature exceeds the gelatinization temperature. In addition to gelatinizing the starch, the hydrolytic agents reduce the molecular weight or chain length of the resulting carbohydrate molecules. Therefore, gelatinized starch may be the product of treatment with heat, enzymes, acids, or other chemical agents. This treatment will improve the binding characteristics of the starch so that it can be used to bind particulate mineral material together to form pellets.

Unfortunately, modified native starch is believed to be an unacceptable binder, as has been discussed hereinabove. In order to modify the characteristics of modified native starch base binders, the applicants have included about 0.2–70%, preferably about 0.5–50%, more preferably about 0.5–25% of a binding modifier. The binding modifier includes an amount of water-dispersible polymer material effective to reduce the rate of growth of mineral ore pellets during conventional balling processes when the pellets include modified native starch base binders. The water-dispersible polymer materials of the present invention include, but are not limited to, water-dispersible natural gums, water-dispersible pectins, water-dispersible starch derivatives, water-dispersible cellulose derivatives, and water-dispersible acrylic polymers. The natural gums include: terrestrial plant exudates including, but not limited to, gum arabic, gum tragacanth, gum karaya, and the like; terrestrial plant seed mucilages, including but not limited to, psyllium seed gum, flax seed gum, guar gum, locust bean gum, tamarind kernel powder, okra, and the like; derived marine plant mucilages, including but not limited to, algin, alginates, carrageenan, agar, furcellaran, and the like; other terrestrial plant extracts including but not limited to arabinogalactan, pectin, and the like; microbial fermentation products including but not limited to xanthan, dextran, scleroglucan, and the like. Cellulose derivatives include chemical derivatives of cellulose, including but not limited to, alkyl, carboxyalkyl, hydroxyalkyl and combination ethers, and the sulfonate and phosphate esters. Water-dispersible starch derivatives include, but are not limited to, alkyl, carboxyalkyl, hydroxyalkyl and combination ethers of starch, phosphate or sulfonate esters of starch and the like which are prepared by various chemical or enzymatic reaction processes. Water-dispersible acrylic and vinyl polymers, include but are not limited to the homo-, co-, and ter- polymers of acrylic and vinyl monomers such as acrylamide, acrylic acid, vinyl alcohol, vinyl acetate, Dimethyl Diacrylyl Ammonium Chloride (DMDAAC), Acrylaminyl Propyl Sulfonate (AMPS) and the like, and combinations thereof.

Figure 2:
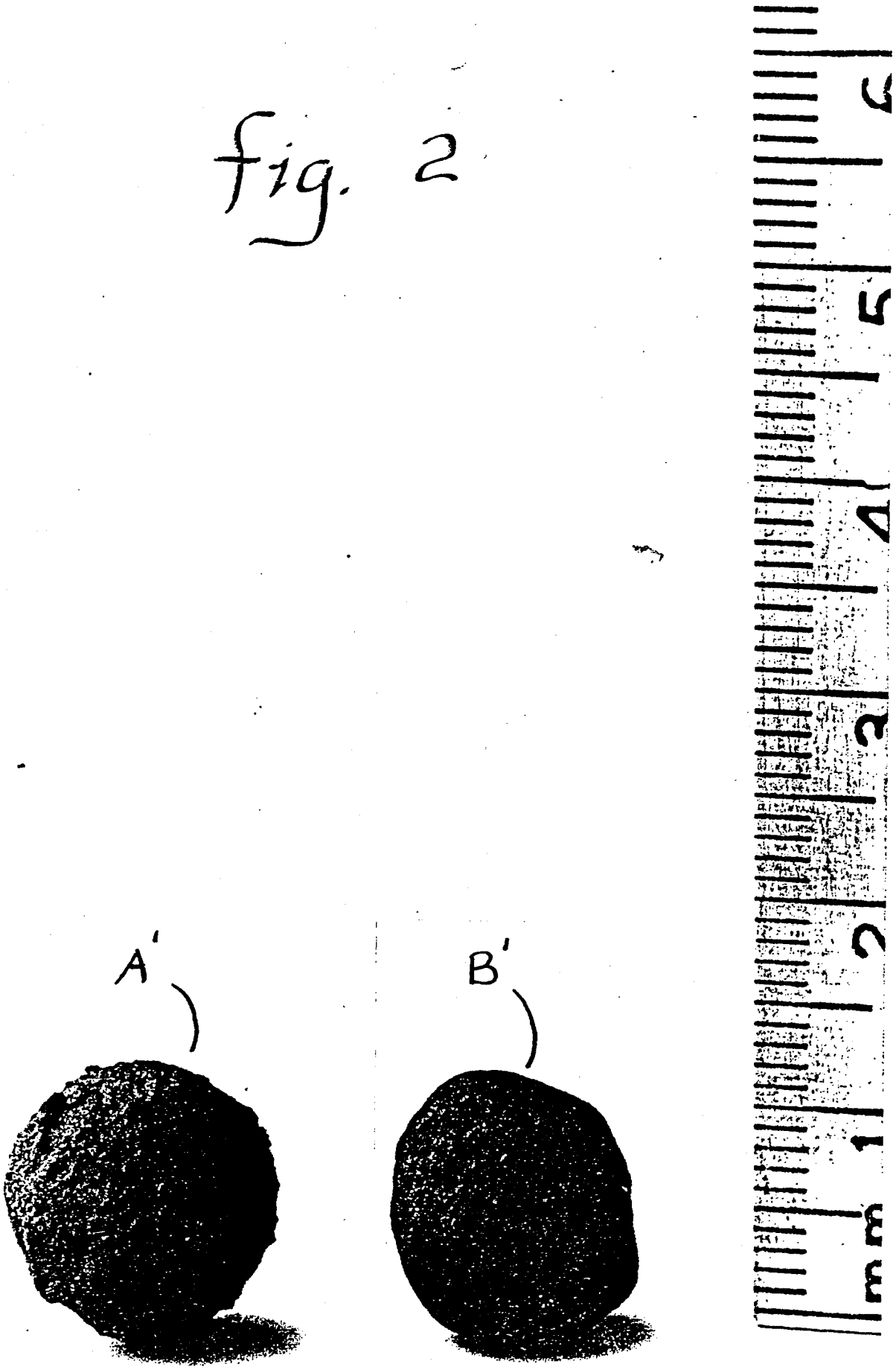
FIG. 2 is a photographic depiction of a magnified view of two pellets having binders including modified corn starch, pellet B' being a preferred iron ore pellet in accordance with the present invention and pellet A' being an iron ore pellet made with a modified starch base binder not within the scope of the present invention.

The inclusion of the binding modifier in the modified native starch base binder has been shown to improve the binding characteristics of the binder. Experimental results: show that the "cratering" effect is absent or reduced, as is the "orange peel" effect in the surface of pellets prepared in accordance with the present invention. FIGS. 1 and 2 provide comparisons of pellets which were made using modified native starch base binders with (B and B') and without (A and A') a binding modifier in accord with the present invention. In FIG. 1, a representative pellet (A) containing 0.15% modified wheat starch is compared to another pellet (B) containing 0.12% modified wheat starch and 0.03% guar gum. In FIG. 2, a representative pellet (A') containing 0.147% modified corn starch is compared to another pellet (B') containing 0.118% modified corn starch and 0.029% guar gum. Each of the comparisons was made employing the same ingredients under similar conditions, except as noted. In each comparison, the pellet without the binding modifier, guar gum, displays a rougher surface than is displayed by the pellet including both starch and guar gum. The pellets without the modifier show a "cratered" surface and the rough "orange peel" effect which is considered unacceptable in the pelletizing industry.

It is believed, but not relied upon, that the binding modifier of the present invention modifies the water retention characteristics of the modified native starch base binder. How and why this occurs are not known. It is apparent that the binding modifier modifies the binding characteristics of modified native starch based binders such that the rate of growth of mineral ore pellets can be reduced during conventional balling processes. At the same time, it is apparent that the pellets which are produced using the binder of the present invention possess a more even or smooth surface, lacking the "cratering" or the "orange peel" effect generally observed on the surfaces of pellets having simple starch base binders. In addition, the surface of green pellets made in accordance with the present invention do not exhibit the tackiness generally associated with high moisture content green pellets using simple starch base binders.

It is believed, but not relied upon, that starch binders somehow allow or encourage excessive water migration away from the interior of the green balls during and/or after balling. It is believed that this effect results in the rapid growth rates associated with starch binders, the "cratering" effect, the "orange peel" effect and the surface tackiness observed on the surface of green pellets prepared with starch binders. It is not known how the binding modifier of the present invention modifies the binding characteristics of starch binders, however, empirical results indicate that a desirable effect occurs. In addition, the drop strength and dry strength of pellets made with binders in accordance with the present invention are not only acceptable, but appear to be quite desirable. Furthermore, experiments indicate that mineral materials containing moisture having significantly different ionic characteristics have little effect upon the binding characteristics of the binder of the present invention. Therefore, it may be concluded that the binder of the present invention is relatively insensitive to variations in the ioninicity of the moisture in the concentrate, or to "water chemistry".

An alternate embodiment of the present invention provides a mineral ore pellet prepared by a process comprising the steps of forming a mineral concentrate including about 50–99.98%, preferably about 80–99.98% mineral material having a moisture content of about 6–12%, preferably about 8–10%, about 0.01–10.0%, preferably about 0.01–1.0%, more preferably about 0.01–0.5% modified native starch, and about 0.001–0.1%, preferably about 0.001–0.05% of water-dispersible polymer material selected from the group consisting of natural gums and water-dispersible synthetic polymers; and forming mineral ore pellets from the mineral concentrate. Preferably, the step involving forming mineral ore pellets includes balling the mineral concentrate in a conventional balling apparatus.

Another embodiment of the present invention provides a mineral ore pellet prepared by a process comprising the steps of extruding native starch at a temperature effective to modify said native starch so that said starch is at least partially gelatinized; combining said modified native starch with water-dispersible polymer material and particulate mineral material to thereby form a mineral concentrate including about 0.01–0.5% modified native starch and about 0.001–0.1% of water-dispersible polymer material, and forming mineral ore pellets from the mineral concentrate. The mineral ore concentrate preferably has an iron content of at least about 35%, more preferably about 50% and most preferably about 60% iron.

The present invention also provides a method of binding particulate mineral material comprising the steps of mixing modified native starch, water-dispersible polymer material and particulate mineral material having a moisture content of about 6–12%, preferably about 8–10%, to form a mineral concentrate; and, balling the mineral concentrate to form agglomerate mineral ore pellets. The mineral concentrate includes about 0.01–10.0%, preferably about 0.01–1.0% modified native starch and about 0.001–0.1% of water-dispersible polymer material. Alternatively, the present invention provides a method o making mineral ore pellets having modified native starch base binders comprising the steps of preparing a binder in accordance with the present invention, mixing the binder with mineral material having a moisture content of about 6–12%, preferably about 9–10%, to form a mineral concentrate, and forming mineral ore pellets from the concentrate. The mineral concentrate preferably includes about 80–99.98% mineral material and about 0.01–10.0%, preferably about 0.01–1.0% of a binder.

The invention will be further described by reference to the following detailed experimental results.

EXPERIMENTAL

Samples of iron ore mineral material from production facilities in Northern Minnesota are obtained to test various modified native starch base binders. The samples are stored in airtight containers to ensure that evaporative losses did not occur prior to mixing the samples with binder. The moisture content of the mineral material is determined by weighing a sample of the concentrate, drying it, and then weighing it again. Data from particle size analyses of the mineral material are obtained from production records based on U.S. Standard Sieve Analyses. Data regarding iron content obtained from production records which report the results of standard iron analyses as a percent of iron (dry basis). The samples typically had moisture contents of about 9.5%, particle sizes of 82–92% less than 44 microns in diameter (U.S. standard No. 325 mesh), and iron contents of 67–68%.

Binders are prepared using two pregelatinized native starches. Each of the native starches, secondary wheat starch and corn starch, had been previously modified using heat processing by mixing them with a relatively small amount of water and then extruded through a screw extrusion device such as a Wenger Extruder (Wenger Manufacturing, Inc., Sabetha, Kans.) which generates sufficient heat and pressure to gelatinize the starch. A sample of the extruded starch is weighed, and dried and weighed again to determine its moisture content which was about 7%. The extrusion process generated sufficient heat to "flash" off most of the moisture. The starch was then ground to a fine size in a Pitchford blender and screened on a 44 micron screen (U.S. standard No. 325 mesh). The plus 44 micron starch was discarded and the minus 44 micron starch was used to prepare modified native starch base binders in accord with the present invention. Some "dextrinization" or heat degradation of the modified or gelatinized product was evident from the slight "browning" of the samples Two different binding modifiers were used. Each was ground in a Pitchford blender and screened through a 44 micron screen. The plus 44 micron material was discarded and the minus 44 micron material was used to prepare the binders of the present invention. The first binding modifier was milled endosperm of guar seed which has been wet flaked, dried, and pulverized (hereinafter "guar gum"). The other binding modifier is a synthetic water-soluble nonionic, high molecular weight, polyacrylamide Calgon 550 (obtained from Calgon Corporation, Pittsburgh, Pa.).

The binders were prepared by combining the various weight proportions of the components and thoroughly mixing. It will be appreciated, however, that the specific components of the binders need not be mixed together prior to use, but may instead be mixed with the mineral material individually, either in series or simultaneously, both prior to or during agglomeration processes such as normal balling processes and the like.

Green pellets were prepared using each of the binders with the following balling procedure. 750 g of particulate mineral material having a moisture content of about 9.5% used as a head sample. A measured quantity of additional water, which varied between 6 and 14 grams, was mixed into the head sample so as to produce green pellets having a moisture content in the range of 8.8 to 10.1%. The desired quantity of binder was added to the head sample and mixed into the sample over a two minute period of time to form a mineral material including the desired quantity of binder. Approximately 75 g of the concentrate was balled to form seed pellets in an airplane tire balling drum rotating at approximately 25 rpm. Additional measured amounts of water were added as required to obtain good ball growth. Additional concentrate was then added along with additional measured spray water to increase the average pellet diameter. The pellets were then screened on a 6 mesh sieve to remove undersized pellets. The larger pellets were then returned to the balling drum with additional concentrate and rotated for about 15 minutes at approximately 25 rpm until approximately 500 grams of pellets were formed. The finished pellets were screened using a U.S. Standard Sieve Analysis and the $-\frac{1}{2}+7/16$ inch pellets were collected and re-rolled for 20 seconds to randomize the pellets for subsequent random selection for further testing. Approximately 300 grams of finished green pellets were prepared in this manner for each of the mineral materials listed in Table 1 below.

The finished pellets were sealed in an airtight container to maintain their moisture content. Twenty pellets from each batch of newly prepared green pellets were immediately tested for drop strength. Thirty pellets from each batch were weighed, dried at 105° C, reweighed, and compressed to determine their average fracture strength. Before and after drying, observations were made regarding the surface characteristics of the pellets. The moisture content was calculated by comparing the weight of the moist pellets to the weight of the dry pellets. The average fracture strength was calculated by averaging the fracture strength of the 30 pellets which were tested. Other observations were also made including observations of pellet surface characteristics and weights of water added to obtain desired pellet moistures.

It was evident that the pellets containing the binder of the present invention showed improved surface characteristics. The "cratering" effect and the "orange peel" effect which were both evident on the surfaces of the pellets made with the binders which included only wheat starch or corn starch, were eliminated or at least minimized or reduced on the surfaces of pellets containing the binders of the present invention. Furthermore, the wet or "tacky" green pellet surface, typical of high moisture green pellets containing binders comprising solely modified native starch was also eliminated or minimized in green pellets containing the binders of the present invention. The drop strength and dry strength were also found to be acceptable for those pellets using binders in accordance with the present invention. Furthermore, the growth rates seen with concentrates including the binder of the present invention were more acceptable than those for concentrates including binders consisting solely of modified starch. Table I hereinbelow lists some of the empirical observations with respect to the surface characteristics of iron ore pellets which were prepared using common mineral material.

TABLE 1

Surface Characteristics of Iron Ore Pellets with Modified Native Starch Base Binders

| Percent of Binder Components Added | Observed Surface Characteristics |
|---|---|
| None Used | WET, SEVERE ROUGHNESS, LUMPY |
| 0.126% extruded wheat starch | WET, TACKY, SEVERE ROUGHNESS, PROTRUSIONS ATTACHED, RAPID GROWTH |
| 0.148% extruded corn starch | WET, TACKY, SEVERE ROUGHNESS, PROTRUSIONS ATTACHED, RAPID GROWTH |
| 0.022% guar gum | SOME CRATERING, GENERALLY SMOOTH SURFACE, SOME LUMPINESS |
| 0.012% nonionic, high molecular weight polyacrylamide | MODERATE SURFACE ROUGHNESS |
| 0.126% extruded wheat starch & 0.022% guargum | SMOOTH SURFACE, DRY, NO PROTRUSIONS |
| 0.126% extruded corn starch & 0.022% guar gum | SMOOTH SURFACE, DRY, NO PROTRUSIONS |
| 0.136% extruded wheat starch & 0.012% nonionic, high molecular weight polyacrylamide | SMOOTH SURFACE, DRY, NO PROTRUSIONS |

SODIUM FREE PELLETS

The sodium CMC binders being marketed today contain significant quantities of sodium carbonate, typically 15–30% by weight in addition to the sodium contained in the polymer. The acrylamide binders contain as much as 50% sodium carbonate. The negative effects of alkalis on iron ore pellet characteristics have been described by Ajersch et al. (1985, 4th International Symposium on Agglomerations, Iron and Steel Society Journal, pp. 259–266). The authors state that it has been widely documented that the potassium, and sodium contents in commercial pellets have very undesirable effects of swelling and sticking in the upper regions of the charge, and occasional blocking of the shaft of the furnace in the temperature range from 700°–800° C., incurring increased maintenance and operations difficulties.

It is noted that the starch binder compositions of the present invention have very low, preferably substantially no sodium and potassium contents. An example is the starch/guar mixture. This binder is substantially sodium and potassium free as compared to the approximate 15–30% Na content of CMC-soda ash and polyacrylamide-soda ash binders being marketed and, therefore, will not contribute to the negative effects of alkali on the swelling characteristics of pellets, particularly fired pellets (see minimal swelling characteristics recorded for pellets with this binder in Table 6).

The starch/acrylamide and starch/CMC binders of the present invention contain small amounts of sodium in the polymer, but do not require sodium carbonate to function properly. Adding sodium carbonate to the starch binders will result in increased dry compression strengths, but this increase in strength is not considered necessary for most operations. Test data shows that adding 0.024% soda ash to starch and starch/polymer pellets raises the dry compression strength of the pellet by about 1–2 pounds. It will be understood that all of the binders of the present invention can be used in conjunction with other binders and additives, such as bentonite, limestone or dolomite.

DRIED PELLET SURFACE EFFECTS

Starch bound pellets produced without the addition of a small amount of water-dispersible polymer material as per the present invention, exhibit the negative phenomena of rapid and uncontrollable pellet growth and wet, tacky surfaces which produce fragile, erodible pellet surfaces when dried.

Several different types of pelletizing furnaces are used in the industry. The two principal furnaces are; the traveling grate in which the entire drying, preheating, firing, and cooling operation takes place on the grate; and the grate kiln in which the pellets are dried and preheated on a grate and then fired in a rotary kiln. In either case, moist, "green" balls are fed onto a steel conveyer or grate which travels into the furnace. The pellet bed depth is typically in the range of 12–16 inches deep on the grate. Hot, high velocity air is blown through the pellets as the grate travels forward. The air temperature is initially quite low, in the range of about 400° F. (200° C.). The air dries the pellets at a rate slow enough to prevent steam explosions fom causing catastrophic failure of the pellets. The temperature is increased as the pellets dry and as the bed moves forward, initiating a process which starts grain growth between iron ore particles and increases strength. Eventually, the pellets will reach a temperature of about 2200°–2400° F. (1200°–1300° C.) which is sufficient to provide the necessary oxidation and grain growth required to produce a "hard" pellet.

The drying and preheat zone of the furnace is a critical area. Dried pellets are quite fragile, thus the need for "dry strength" and "smooth surfaces". The high air velocities in a furnace will erode loosely attached material on the surface of the dried pellet. Starch pellets have historically displayed this characteristic. Eroded pellets will collapse and allow air channeling in the pellet bed. Air channeling then increases the velocity in the eroded area since the resistance to air flow is decreased. This can result in catastrophic failure of the pellet bed. When this occurs, the furnace production must be slowed to stabilize operations or low quality production must be accepted. Dust losses in the furnace, in this situation, would be severe.

Applicant's observations indicate that the addition of small amounts of water-dispersible polymer material in accordance with the present invention significantly reduces the surface erosion characteristics of starch bound pellets.

PELLET GROWTH RATES

"Starch" pellets are characterized by "rapid pellet growth" during balling and "wet" or "tacky" surfaces. It appears that these phenomena are related to the quality of the pellet surface. Therefore, a series of pellet growth rate tests, described were conducted with binders including various binding modifiers and modified starch base binders to determine their respective effects on growth rates.

In each growth rate test, 750 grams of 9.5% moisture iron ore miner material was mixed with 14 g of additional water. A measured quantity of binder was then blended into the mixture. 100 g of the resulting mixture was then added to the balling drum which was operating at 25 rpm and 40 g of minus 4 mesh plus 6 mesh seed pellets were generated. The 40 grams of seed pellets were then added back to the balling drum and another 500 grams of blended concentrate was added to the drum over a 15 second period. The balling process was allowed to continue for 90 seconds from the time the 500 gram sample addition was begun. This process was repeated for each of the binders listed in Table 2 below.

The pellets were then removed from the drum and screened through ¼ inch, U.S. No. 4 mesh, and U.S. No. 6 mesh screens. The cumulative percentage of green balls retained on each screen is reported in Table 2 below.

The results, reported in Table 2 below, indicate that there is a correlation between ball growth rate, starch content, and binding modifier or water-dispersible polymer type and quantity. The data is believed to establish that small quantities of water-dispersible polymer material can significantly slow the balling rate of starch pellets as compared to comparable quantities of additional starch. It is also believed that the charge and molecular weight of the polymer material used affects the balling rate.

TABLE 2

Ball Growth Rate
Modified Native Starch Base
Binder Iron Ore Pellets

| Percent of Starch and Modifier in the Blended Concentrate | % + ¼" | % + 4 mesh | % + 6 mesh |
|---|---|---|---|
| None (100% Concentrate) | 90 | | |
| 0.118% extruded corn starch | 71 | | |
| 0.147% extruded corn starch | 79 | | |
| 0.199% extruded corn starch | 76 | | |
| 0.118% extruded corn starch & 0.013% guar gum | 48 | | |
| 0.118% extruded corn starch & 0.029% guar gum | 26 | | |
| 0.118% extruded corn starch & 0.081% guar gum | 11 | | |
| 0.118% extruded corn starch & 0.029% high molecular weight anionic acrylamide | 68 | 88 | 99 |
| 0.118% extruded corn starch & 0.029% low molecular weight anionic acrylamide | 30 | 69 | 91 |
| 0.118% extruded corn starch & 0.029% medium molecular weight anionic acrylamide | 15 | 50 | 84 |
| 0.118% extruded corn starch & 0.029% medium molecular weight cationic acrylamide | 11 | 46 | 81 |
| 0.118% extruded corn starch & 0.029% high molecular weight cationic acrylamide | 8 | 27 | 64 |

TABLE 2-continued

Ball Growth Rate
Modified Native Starch Base
Binder Iron Ore Pellets

| Percent of Starch and Modifier in the Blended Concentrate | % + ¼" | % + 4 mesh | % + 6 mesh |
|---|---|---|---|
| 0.118% extruded corn starch & 0.029% high molecular weight nonionic polyacrylamide | 6 | 23 | 63 |
| 0.118% extruded corn starch & 0.029% high molecular weight anionic polyacrylamide | 4 | 14 | 38 |

DRY PELLET ABRASION TESTS

The resistance to abrasion and dust losses of pellets in the drying zone of the furnace is simulated by the DRY ABRASION TEST. Iron ore Pellets were prepared as described above for tests to determine pellet growth rates. The green pellets were then thoroughly dried at 105° C., weighed, and their abrasion resistance was measured by tumbling the dried pellets for 4 revolutions in a 20 cm balling disk rotating at 16 rpm at a 45° angle. The percent weight loss was used to evaluate the relative abrasion resistance of the dried but unfired pellet.

The dry abrasion data, reported in Table 3 below, shows that pure polymer added at equivalent percentages to those used in the starch/polymer binders provide little dry abrasion strength to the pellets. Increasing the starch content of the pure starch pellets does not significantly improve the abrasion resistance of those pellets. Yet, the data show that the addition of small amounts of polymer to starch pellets significantly improves the loss on abrasion, a result that could not be predicted from drop and dry strength data since the pure starch pellets had equivalent or better drop and dry strengths as compared to the starch/polymer pellets evaluated in those tests.

TABLE 3

Dry Abrasion Test
Modified Native Starch Base
Binder Iron Ore Pellets

| Percent of Starch and Modifier in the Blended Concentrate | Percent Loss on Abrasion |
|---|---|
| 0.015% nonionic acrylamide | 3.41 |
| 0.029% guar gum | 3.73 |
| 0.074% guar gum | 1.24 |
| 0.118% extruded corn starch | 1.16 |
| 0.147% extruded corn starch | 1.01 |
| 0.140% extruded corn starch & 0.007% guar gum | 0.89 |
| 0.133% extruded corn starch & 0.015% guar gum | 0.82 |
| 0.118% extruded corn starch & 0.029% guar gum | 0.79 |
| 0.074% extruded corn starch & 0.074% guar gum | 0.25 |
| 0.133% extruded corn starch & 0.015% nonionic acrylamide | 0.73 |
| 0.118% extruded corn starch & 0.029% nonionic acrylamide | 0.62 |

Fired Pellet Characteristics

A binder including 80 percent extruded corn starch/20 percent guar gum was added at a rate of 0.16 percent by weight to 600 pounds of iron ore concentrate from National Steel Pellet Co. (Keewatin, Minn.) along with 1 percent by weight ground limestone and thoroughly mixed in a mueller mixer. This material was then continuously conveyed to an industrial standard, 4 foot diameter pelletizing disk where it was formed into green balls. Water was added as required to maintain stable balling action. Pellet growth characteristics were observed to be consistent with those needed to produce high quality pellets and did not display the negative characteristics previously seen with starch bound pellets. In particular, the growth rate was similar to that seen using bentonite as a binding agent, and the balls did not display the characteristics rapid growth rate, tackiness and orange peel characteristics of starch bound pellets. Samples of the green pellet were collected and analyzed to determine their characteristics.

Sixty-five and one-half pounds of green pellets were fired in a 1 foot square, McKee type pot furnace to evaluate the characteristics of the fired pellets. This test simulated the actual drying and firing air flows and temperature cycles seen in a Grate Kiln pelletizing machine. A 4-inch-thick hearth layer of prefired pellets separated the green pellets from the grate bars and was separated from the green pellets by nichrome wire screen to prevent mixing of the hearth layer and green pellets. A six-inch bed of green pellets was placed on the hearth layer pellets and fired under the conditions reported in Table 4. Green pellet quality measurements for pellets produced in the 4-foot balling disk are reported in Table 5. Fired pellet quality measurements for fired pellets from the pot furnace test are reported in Table 6.

Test procedures used in obtaining the results in Table 6 are referenced parenthetically. In those references American Society for Testing and Materials is appreviated ASTM, and International Organization for Standardization is abbreviated ISO. The test procedures referenced are well known in the art.

Fired pellet quality was excellent with the high compression strengths and high reducibility rates indicating that the fuel rate could be reduced.

TABLE 4

| Test Phase | Pressure Drop (Inches of Water Displaced) | Firing Cycle: Time at Temp (Min.-Sec.) | Actual Temp. °F. | Location (Actual T.) | Input (Temp. °F.) |
|---|---|---|---|---|---|
| Downdraft Dry | 10 | 2 - 36 | 615 | Bed Top | 700 |
| Downdraft Dry | 8.5 | 1 - 34 | 1260 | Bed Top | 1350 |
| Downdraft Dry | 7 | 0 - 34 | 1320 | Bed Top | 1350 |
| Preheat | 7 | 2 - 36 | 1250 | UnderBed | 1950 |
| Firing | 5 | 6 - 30 | 2170 | UnderBed | 2075 |
| Firing | 5 | 6 - 30 | 2235 | UnderBed | 2300 |
| Firing | 6 | 6 - 30 | 2295 | UnderBed | 2375 |
| Firing | 5 | 6 - 30 | 2315 | UnderBed | 2300 |
| Cooling | 11 | 10 - 0 | 695 | Bed Top | Ambient |

TABLE 5

| Green Pellet Measurements | |
|---|---|
| Percent Moisture - Percent by weight | 9.41 |
| 18" Drop Strength | 6.2 |
| Wet Compression Strength - pounds | 1.66 |
| Dry Compression Strength - pounds | 11.12 |

TABLE 6

| Fired Pellet Measurements And Visual Observations | |
|---|---|
| Top of Pellet Bed | No cracking, Minor clustering |
| Middle of Pellet Bed | Minor cracking, minor clustering |
| Bottom of Pellet Bed | Moderate cracking, Minor clustering |
| Crushing Strength (ASTM E382-80) Pounds | 1000 |

TABLE 6-continued

| Fired Pellet Measurements And Visual Observations | |
|---|---|
| Swelling (ISO Dp 4698) percent volume | 13.1 |
| R40 Reducibility (ISO Dp 4695) percent oxygen loss per minute at 40% reduction | 1.10 |
| Low temperature Degradation (ISO Dp 4697) | |
| Porosity as Measured by Air Comparison Pycnometer (percent voids) | 27.07 |
| Bulk Density - Grams/0.1 cubic foot | 5145 |
| Tumble Test (ASTM E 279-69) | |
| Screen Analysis before Tumble - Percent by Weight | |
| +½ inch | 28.6 |
| −½ inch + ⅜ inch | 68.9 |
| −⅜ inch + ¼ inch | 2.3 |
| −¼ inch + 28 Mesh | 0.1 |
| −28 Mesh | 0.1 |
| Screen Analysis after Tumble - Percent by Weight | |
| +½ inch | 19.1 |
| −½ inch + ⅜ inch | 68.6 |
| −⅜ inch + ¼ inch | 6.4 |
| −¼ inch + 28 Mesh | 1.5 |
| −28 Mesh | 4.4 |

SURFACE ROUGHNESS OF STARCH AND STARCH/POLYMER PELLETS

FIG. 1 is a picture of two fired pellets. Both pellets contain 0.147% binder by weight. The pellet on the left (A) contains 0.147% extruded wheat starch and the pellet on the right (B) contains 0.118% extruded wheat starch and 0.029% guar gum. Both sets of pellets were produced under identical conditions using the same concentrates water addition rates and controlling other variables to maintain similar balling conditions. The green pellets were screened to minus ½ inch plus 7/16 inch, placed in one, multicompartment wire basket, and inserted in a muffle furnace preheated to 65° C. The pellets were then heated to 1265° C. at a rate of 9° per minute, removed from the furnace and air cooled.

As is apparent from an examination of FIG. 1 the starch bound pellet (A) surface has significant areas of rough, orange peel surface while the starch/polymer pellet (B) is relatively smooth. One can see from the rough surface of the starch bound pellet that it would be fragile and easily erodible during the drying and preheating process. This fact is confirmed by the dry abrasion tests previously described. Again, the critical improvement appears to be related to the ability of small amounts of water-dispersible polymer material to control the green pellet growth rate and the quantity of moisture on the surface of the green pellets during the balling process, a factor which greatly reduce surface irregularities on the pellets.

FIG. 2 is a picture of two fire pellets containing extruded corn starch in place of the wheat starch, and the same amounts of everything else.

Example Formulations

The following example formulations of a water-dispersible polymer and a pregelatinized starch have been found to provide satisfactory pellet formation with wet taconite concentrates. Typical moisture contents and strength test results are given with these formulations.

EXAMPLE 1

| | |
|---|---|
| Binder Composition: | |
| Guar gum (Rantec D-1) | 15% |
| Finely-ground, modified (extruded), secondary wheat starch | 85% |
| Binder Addition Rate: 0.148% (dry basis) | |
| Ore Concentrate Source: LTV, Hoyt Lakes, MN | |
| Typical Moisture and Strength Results: | |
| % Moisture | 9.32 |
| 18" Drop (lb.) | 5.6 |
| Dry Compression (lb.) | 5.2 |

EXAMPLE 2

| | |
|---|---|
| Binder Composition: | |
| Guar gum (Rantec D-1) | 20% |
| Finely-ground, modified (extruded), secondary wheat starch | 80% |
| Binder Addition Rate: 0.148% (dry basis) | |
| Ore Concentrate Source: LTV, Hoyt Lakes, MN | |
| Typical Moisture and Strength Results: | |
| % Moisture | 9.30 |
| 18" Drop (lb.) | 6.3 |
| Dry Compression (lb.) | 5.6 |

EXAMPLE 3

| | |
|---|---|
| Binder Composition: | |
| Guar gum (Rantec D-1) | 20% |
| Finely-ground, modified (extruded), secondary wheat starch | 80% |
| Binder Addition Rate: 0.148% (dry basis) | |
| Ore Concentrate Source: Eveleth Taconite, Eveleth, MN | |
| Typical Moisture and Strength Results: | |
| % Moisture | 9.37 |
| 18" Drop (lb.) | 6.5 |
| Dry Compression (lb.) | 5.2 |

EXAMPLE 4

| | |
|---|---|
| Binder Composition: | |
| Guar gum (Rantec D-1) | 15% |
| Finely-ground, modified (extruded) corn starch | 85% |
| Binder Addition Rate: 0.148% (dry basis) | |
| Ore Concentrate Source: Eveleth Taconite, Eveleth, MN | |
| Typical Moisture and Strength Results: | |
| % Moisture | 9.27 |
| 18" Drop (lb.) | 5.2 |
| Dry Compression (lb.) | 7.1 |

EXAMPLE 5

| | |
|---|---|
| Binder Composition: | |
| Pregelatinized tamarind kernel powder | 50% |
| Modified (extruded) secondary wheat starch | 50% |
| Binder Addition Rate: 0.148% (dry basis) | |
| Ore Concentrate Source: LTV, Hoyt Lkes, MN | |
| Typical Moisture and Strength Results: | |
| % Moisture | 9.25 |
| 18" Drop | 7.2 |
| Dry Compression, lb. | 7.2 |

EXAMPLE 6

| | |
|---|---|
| Binder Composition: | |
| Xanthan (finely-ground Rhodopol 23) | 4% |
| Finely-ground, modified (extruded), secondary wheat starch | 96% |
| Binder Addition Rate: 0.148% dry basis) | |
| Ore Concentrate Source: LTV, Hoyt Lakes, MN | |
| Typical Moisture and Strength Results: | |
| % Moisture | 9.11 |
| 18" Drop (lb.) | 4.2 |
| Dry Compression (lb.) | 7.0 |

EXAMPLE 7

| | |
|---|---|
| Binder Composition: | |
| Polyacrylamide (finely-ground Calgon M-550) | 10% |
| Finely-ground, modified (extruded) corn starch | 90% |
| Binder Addition Rate: 0.148% (dry basis) | |
| Ore Concentrate Source: Eveleth Taconite, Eveleth, MN | |
| Typical Moisture and Strength Results: | |
| % Moisture | 9.17 |
| 18" Drop (lb.) | 5.5 |
| Dry Compression (lb.) | 7.9 |

EXAMPLE 8

| | |
|---|---|
| Binder Composition: | |
| 30% Acrylic acid/60% Acrylamide 10% AMPSA | 2.5% |
| Neutralized polyacrylic acid | 2.5% |
| Finely ground, modified (extruded) corn starch | 95% |
| Binder Addition Rate: 0.148% (dry basis) | |
| Ore Concentrate Source: Eveleth Taconite, Eveleth, MN | |
| Typical Moisture and Strength Results: | |
| % Moisture | 9.2 |
| 18" Drop (lb.) | 6.0 |
| Dry Compression (lb.) | 5.5 |

EXAMPLE 9

| | |
|---|---|
| Binder Composition: | |
| Guar gun | 14.0% |
| Neutralized polyacrylic acid | 1.0% |
| Finely ground, modified (extruded) corn starch | 85.0% |
| Binder Addition Rate: 0.148% (dry basis) | |
| Ore Concentrate Source: Eveleth Taconite, Eveleth, MN | |

-continued

| Typical Moisture and Strength Results: | |
|---|---|
| % Moisture | 9.5 |
| 18" Drop (lb.) | 4.9 |
| Dry Compression (lb.) | 4.7 |

While certain representative embodiments of the invention have been described herein for purposes of illustration, it will be apparent to those skilled in the art that modifications therein may be made without departing from the spirit and scope of the invention.

What is claimed is:

1. An iron ore concentrate for forming iron ore pellets, said concentrate comprising:

(a) about 80–99.98 percent mineral material including about 6–12 percent moisture and at least about 35 percent iron;

(b) about 0.01–0.5 percent modified native starch; and (c) an amount of water-dispersible polymer material effective to reduce the rate of growth of green pellets during conventional balling processes when said green pellets have modified native starch base binders.

2. The concentrate of claim 1 including about 0.001–0.1 percent of said water-dispersible polymer material.

3. The concentrate of claim 1 wherein said water-dispersible polymer material is selected from the group consisting of water-dispersible natural gums, water-dispersible pectins, water-dispersible starch derivatives, water-dispersible cellulose derivatives, water-dispersible vinyl polymers, water-dispersible acrylic polymers and mixtures thereof.

4. A mineral ore pellet comprising:

(a) about 80–99.98 percent mineral material;

(b) about 0.01–10.0 percent modified native starch; and (c) an amount of water-dispersible polymer material effective to reduce the rate of growth of mineral ore pellets during conventional balling processes when said pellets include a modified native starch base binder.

5. The mineral ore pellet of claim 4, said water-dispersible polymer material being selected from the group consisting of water-dispersible natural gums, water-dispersible pectins, water-dispersible starch derivatives, water-dispersible cellulose derivatives, water-dispersible vinyl polymers, water-dispersible acrylic polymers and mixtures thereof.

6. The mineral ore pellet of claim 5, said water-dispersible polymer material being selected from the group consisting of natural gums, cellulose derivatives, acrylic polymers, vinyl polymers and mixtures thereof.

7. The mineral ore pellet of claim 4 including about 0.01–0.5 percent of said modified native starch, about 0.001–0.1 percent of said water-dispersible polymer material and at least about 50 percent iron.

8. A mineral ore pellet prepared by a process comprising the steps of:

(a) forming a mineral concentrate including about 80–99.98 percent mineral material having a moisture content of about 6–12 percent, about 0.01–10.0 percent modified native starch, and about 0.001–0.1 percent of water-dispersible polymer material selected from the group consisting of natural gums and water-dispersible synthetic polymers; and (b) forming mineral ore pellets from the mineral concentrate.

9. The mineral ore pellet of claim 8, step (b) including balling the mineral concentrate in a conventional balling apparatus to form mineral ore pellets.

10. A mineral ore pellet comprising:

(a) about 90–99.98 percent mineral material including at least about 50 percent iron and having a moisture content of about 6–12 percent;

(b) about 0.01–0.5 percent modified native starch; and (c) an amount of water-dispersible polymer material effective to reduce the rate of growth of mineral ore pellets during conventional balling processes when said pellets include a modified native starch base binder.

11. A mineral ore pellet prepared by a process comprising the steps of:

(a) extruding native starch at a temperature effective to modify said native starch so that said starch is at least partially gelatinized;

(b) combining said modified native starch with water-dispersible polymer material and particulate mineral material to thereby from a mineral concentrate including about 0.01–0.5 percent modified native starch and about 0.001–0.1 percent of said water-dispersible polymer material; and having a content of at least about 50percent iron, said polymer material being selected from the group consisting of water-dispersible natural gums, water-dispersible pectins, water-dispersible starch derivatives, water-dispersible cellulose derivatives, water-dispersible vinyl polymers, water-dispersible acrylic polymers and mixtures thereof; and (c) forming mineral ore pellets from said mineral concentrate.

12. The mineral ore pellet of claim 11, step (c) including balling said mineral concentrate in a conventional balling apparatus to form the mineral pellets.

13. A method of binding particulate mineral material comprising the steps of:

(a) mixing modified native starch, water-dispersible polymer material and particulate mineral material having a moisture content of about 6–12 percent to form a mineral concentrate, the mineral concentrate including about 0.01–10 percent modified native starch and about 0.001–0.1 percent of said water-dispersible polymer material, the water-dispersible polymer material being selected from the group consisting of water-dispersible natural gums, water-dispersible pectins, water-dispersible starch derivatives, water-dispersible cellulose derivatives, water-dispersible vinyl polymers, water-dispersible acrylic polymers; and (b) balling the mineral concentrate to form agglomerated mineral ore pellets.

14. A method of making mineral ore pellets having modified native starch base binders, said method comprising the steps of:

(a) preparing a binder by mixing a binding modifier with a binding agent consisting essentially of modified native starch, said binding modifier including an amount of water-dispersible polymer material effective to reduce the rate of growth of green mineral ore pellets having starch based binders during conventional balling processes and being selected from the group consisting of water-dispersible natural gums, water-dispersible pectins, water-dispersible starch derivatives, water-dispersible cellulose derivatives, water-dispersible vinyl polymers, water-dispersible acrylic polymers and mixtures thereof;

(b) mixing said binder with mineral material having a moisture content of about 6–12 percent to form a mineral concentrate, said mineral concentrate including about 80–99.98 percent mineral material and about 0.01–10 percent of said binder; and (c) forming mineral ore pellets from the mineral concentrate.

15. The method of claim 14 wherein step (c) includes balling the mineral concentrate in a conventional balling apparatus to form the mineral or pellets.

16. The method of claim 14 wherein the mineral ore pellets are iron ore pellets and said mineral material includes at least about 35 percent iron, and wherein said mineral concentrate includes about 0.01–0.5 percent of said binder.

17. The method of claim 14 wherein step (a) is preceded by extruding native starch at a temperature effective to modify said native starch so that said starch is at least partially gelatinized and thereby forming the binding agent consisting essentially of modified native starch.

18. The method of claim 14 wherein said binder modifier includes water-dispersible polymer material selected from the group consisting of natural gums, cellulose derivatives, vinyl polymers, acrylic polymers and mixtures thereof.

19. The method of claim 15 wherein said water-dispersible polymer material is guar gum.

20. An iron ore concentrate for forming iron ore pellets, said concentrate consisting of:

(a) about 80–99.98 percent mineral material including about 6–12 percent moisture and at least about 35 percent iron;

(b) about 0.01–0.5 percent modified native starch; and (c) an amount of water-dispersible polymer material effective to reduce the rate of growth of green pellets during conventional balling processes when said green pellets have modified native starch base binders.

21. The concentrate of 20 including about 0.001–0.1 percent of said water-dispersible polymer material.

22. The concentrate of claim 20 wherein said water-dispersible polymer material is selected from the group consisting of water-dispersible natural gums, water-dispersible pectins, water-dispersible starch derivatives, water dispersible cellulose derivatives, water-dispersible vinyl polymers, water-dispersible acrylic polymers and mixtures thereof.

23. A mineral ore pellet consisting of:

(a) about 80–99.98 percent mineral material;

(b) about 0.01–10.0 percent modified native starch; and (c) an amount of water-dispersible polymer material effective to reduce the rate of growth of mineral ore pellets during conventional balling processes when said pellets include a modified native starch base binders.

24. The mineral ore pellet of claim 23, said water-dispersible polymer material being selected from the group consisting of water-dispersible natural gums, water-dispersible pectins, water-dispersible starch derivatives, water-dispersible cellulose derivatives, water-dispersible vinyl polymers, water-dispersible acrylic polymers and mixtures thereof.

25. The mineral ore pellet of claim 24, said water-dispersible polymer material being selected from the group consisting of natural gums, cellulose derivatives, acrylic polymers, vinyl polymers and mixtures thereof.

26. The mineral ore pellet of claim 23 including about 0.01–0.5 percent of said modified native starch, about 0.001–0.1 percent of said water-dispersible polymer material and at least about 50 percent iron.

* * * * *

UNITED STATES PATENT AND TRADEMARK OFFICE
CERTIFICATE OF CORRECTION

PATENT NO. : 5,000,783

DATED : March 19, 1991

INVENTOR(S) : David L. Dingeman

It is certified that error appears in the above-identified patent and that said Letters Patent is hereby corrected as shown below:

"On the cover page, under "Foreign Patent Documents", kindly replace Canadian Patent number "80342" with --890,342--.
In Column 22, line 23, in Claim 11, "from" should read --form--.
In Column 22, line 7, in Claim 10, "about 90-99.98" should read --90-99.8--.
In Column 22, line 6, in Claim 18, " A mineral " should read --an iron--.
In Column 23, line 14, in Claim 15, "or" should read --ore--.
In Column 24, line 23, in Claim 23, "binders" should read --binder--.

Signed and Sealed this

Second Day of May, 1995

Bruce Lehman

*Attest:*

BRUCE LEHMAN

*Attesting Officer*

*Commissioner of Patents and Trademarks*